United States Patent [19]

Tabei

[11] 4,242,080

[45] Dec. 30, 1980

[54] SAFETY DEVICE FOR GAS BURNERS

[75] Inventor: Tohru Tabei, Zama, Japan

[73] Assignee: Honeywell Inc., Minneapolis, Minn.

[21] Appl. No.: 932,827

[22] Filed: Aug. 11, 1978

[51] Int. Cl.[3] ..... F23Q 9/08

[52] U.S. Cl. ..... 431/54; 137/66

[58] Field of Search ..... 431/54, 6 P, 51, 52, 431/53; 137/66

[56] References Cited

U.S. PATENT DOCUMENTS

| | | | |
|---|---|---|---|
| Re. 23,077 | 1/1949 | Ray | 74/1 |
| 2,715,940 | 10/1955 | Hollman | 158/131 |
| 2,719,531 | 10/1955 | Sogge | 137/66 |
| 2,988,098 | 12/1959 | Thomas | 137/66 |
| 3,099,994 | 8/1963 | Putz et al. | 137/66 |
| 3,303,866 | 2/1967 | Ray | 431/54 |
| 3,476,130 | 11/1969 | Kingma | 137/66 |
| 3,768,332 | 10/1975 | Katchka | 74/491 |
| 3,804,106 | 4/1974 | Buezis et al. | 431/54 X |
| 3,877,475 | 4/1975 | Dietiker | 137/66 |
| 3,973,576 | 8/1976 | Dietiker et al. | 137/66 |
| 4,081,235 | 3/1978 | Van Der Veer | 431/54 |

FOREIGN PATENT DOCUMENTS 1203914 9/1970 United Kingdom .

*Primary Examiner*—Dority, Jr. Carroll B.
*Assistant Examiner*—Randall L. Green
*Attorney, Agent, or Firm*—Clyde C. Blinn; Henry L. Hanson

[57] ABSTRACT

A safety gas valve for gas burners for providing a "super safe" operation wherein upon the main valve being turned to an off position and the safety valve is held in an operative position by the residual heat of the thermocouple, means is provided for preventing the manual member for opening the main valve until the safety valve returns to the inoperative position.

5 Claims, 10 Drawing Figures

SAFETY DEVICE FOR GAS BURNERS

BACKGROUND OF THE INVENTION

The present invention relates to a safety device for use in gas burners, which continues to supply the gas during the presence of flame of combustion. Widely employed safety devices for preventing any possible danger that would be caused by the emission of unburned gases were composed of a thermocouple heated by the pilot flame, and an electromagnetic means energized by the electromotive force of the thermocouple to safely shut off the flow of gas when the flame has been extinguished. According to the above mentioned conventional safety valve devices, the safety valve is maintained at an open position while there is the output from the thermocouple, and the safety valve is restored to the close position when the output has extinguished, providing increased safety performance, economy in manufacturing cost and extended life. The thermocouple, however, has a thermal capacity and continues to produce the output due to the residual heat. Therefore, some period of time was required before the electromagnetic device was sufficiently de-energized. The duration of this time is dependent upon the force for maintaining the safety valve at the open position and the resilient force of a spring or the like for restoring the safety valve to the close position. If the duration of time is long, the flowing amount of the live gas increases after the flame has been extinguished, and an extended period of time is required before the safety valve returns to the close position. A dangerous condition will be presented if the next operation is taken place neglecting the above mentioned period of time. For example, the safety valve starts from the completely close position and supplies the main burner fuel after having supplied the pilot burner fuel, after having ignited the pilot flame and after having confirmed the burn of the pilot flame; the safety is maintained by performing the operation in the order mentioned. However, in case the operation is started again before the safety valve is returned to the completely close position, the aforesaid order of operation is neglected. Accordingly, a variety of contrivances have been devised such that the safety valve is returned to the completely close position before the operation takes place again. Two such gas valves are shown in the U.S. Paul Dietiker Pat. No. 3,877,475 issued Apr. 15, 1975 and the U.S. Paul Dietiker et al Pat. No. 3,973,576 issued Aug. 10, 1976.

SUMMARY OF THE INVENTION

The present invention relates to an improvement in a safety device which is so constructed that the next operation is not permitted to be effected until the electromotive force of the thermocouple is sufficiently reduced by the extinction of flame, or in other words, so constructed that the passage of gas is not allowed to be opened before the safety valve is restored to the completely close position.

BRIEF DESCRIPTION OF DRAWING

The invention is illustrated below with reference to an embodiment in conjunction with the drawings.

DESCRIPTION OF THE INVENTION

Figure 1:
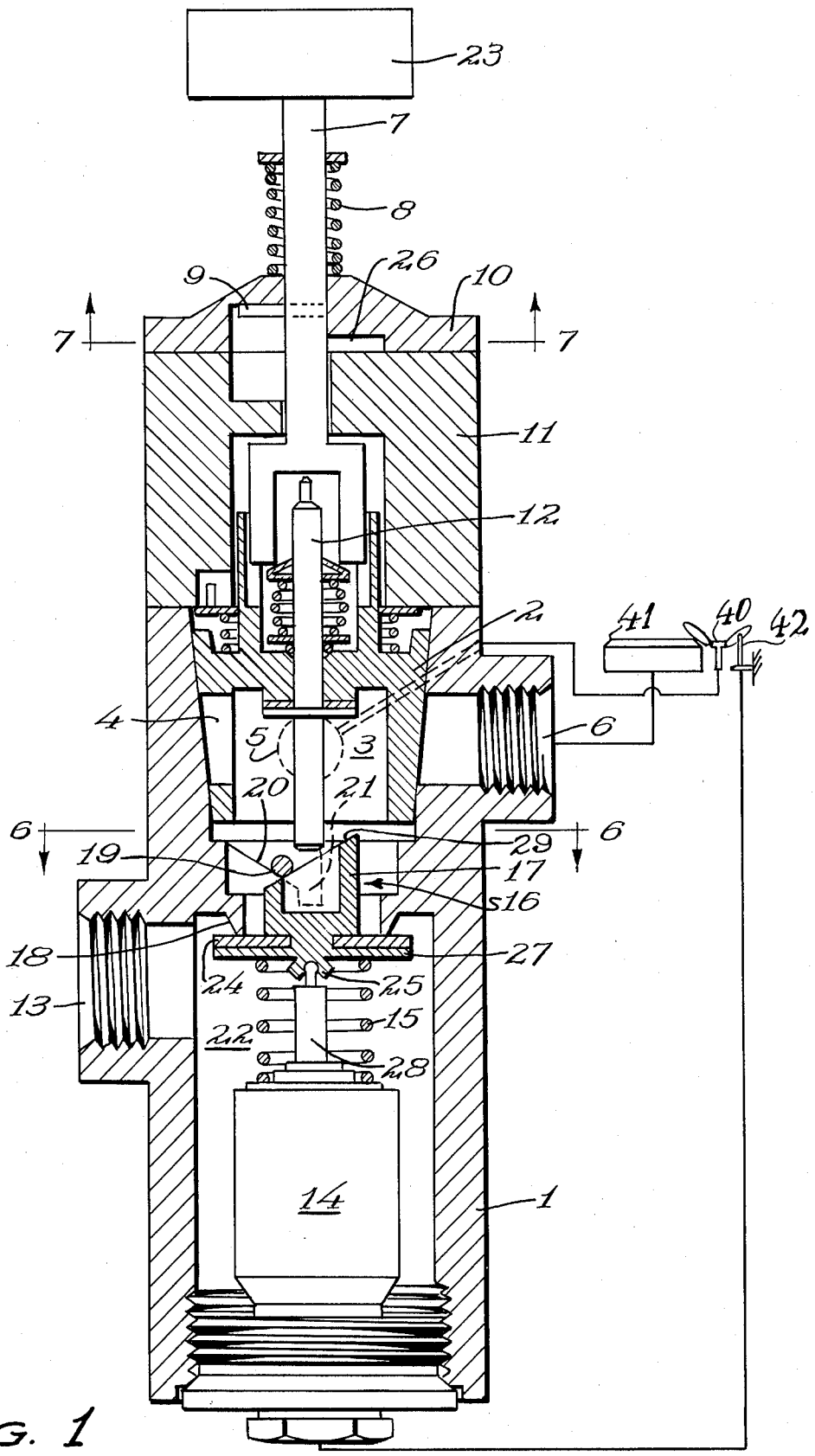
FIG. 1 is a cross-sectional view showing the device of the present invention.

Referring to FIG. 1, a cock 2 is rotatably located at the lower portion 1 of a casing. The cock or main valve 2 has an upper chamber 3 and a communication port 4 communicated to said upper chamber 3. Owing to the rotation of the cock 2, the communication port 4 is allowed to successively face a pilot port 5 and a main port 6 thereby to supply the gas to the pilot flame of a pilot burner 40 and the main burner flame of a main burner 41. At the initial position (completely close position) of the cock 2, the communication port 4 is faced to the closed wall surface in the middle portion 11 of the casing; the gas is not supplied from the communication port 4. As the cock 2 is turned and the communication port 4 is faced to the pilot port 5, the gas is supplied to the pilot flame only via the pilot port 5. As the cock 2 is further turned so that the communication port 4 is faced to the main port 6, the gas is supplied to both the pilot flame and the main burner flame. A safety valve 16 is provided below the cock 2, whereby the upper chamber 3 and a low chamber 22 is separated by the safety valve 16. When a valve disk 24 of the safety valve 16 is closed, i.e. when the communication between the upper chamber 3 and the lower chamber 22 is interrupted by the valve disk 24, no gas is allowed to flow from a gas inlet port 13 to the upper chamber 3. The cock 2 is manually turned by turning a spindle 7 connected to a knob 23. A pin 9 attached to the spindle 7 is inserted in a groove 26 formed between the upper portion 10 of the casing and the middle portion 11 of the casing. The spindle 7 is capable of rotating the cock 2 as well as pressing a reset shaft 12 against the resilient force of the spring 8 in an axial direction. When the reset shaft 12 is compressed, the safety valve 16 moves downwards, so that the valve disk 24 opens the passage of gas. At this moment, if an electromagnetic device 14 has been energized by the electromotive force of the thermocouple 42, the valve disk 24 is maintained at the open position.

First, in the initial state, the cock 2 is at the completely close position, and the gas is supplied from the gas inlet port 13 to the lower chamber 22. The valve disk 24, however, is brought into pressed contact with a valve seat 18 due to the resilient force of the spring 15 to interrupt the gas from flowing into the upper chamber 3. The valve disk 24 is composed of a resilient member such as rubber, and supported by a support plate 27 which is supported by a rod 28 at an engaging portion 25. To the support plate 27 is integrally attached a valve head 17 having a central recess 30. Next, if the knob 23 is pushed against the resilient force of the coil spring 8, the reset shaft 12 is moved downward to press the safety valve head 17. At this moment, if the valve disk 24 is opened, the gas is admitted to flow from the inlet port 13 into the upper chamber 3 through the lower chamber 22.

The second operation consists of turning the knob 23 by 90°. At this moment, the communication port 4 of the cock 2 is faced to the pilot port 5 to supply the gas to the pilot port. Here, if the pilot port is ignited, the electromagnetic device 14 is energized by the electromotive force of the thermocouple. When energized, the electromagnetic device 14 containing a pole piece and a coil for holding the safety valve 16 at the open position, locks the position of the rod 28. When the safety valve 16 is pushed by the reset shaft 12, the rod 28 moves downwards toward the interior of the electromagnetic device 14; the position of the rod 28, therefore, is locked by the energized electromagnetic device 14.

The third operation consists of releasing the knob 23 from being pressed. The safety valve 16, at this moment, has been locked by the electromagnetic device 14 and is maintained in an open position.

Figure 2A:
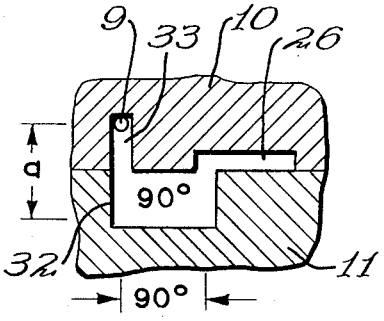
FIG. 2 is a cross-sectional view showing the relation between the rotating position of the cock and the position of the first pin.
Figure 2B:
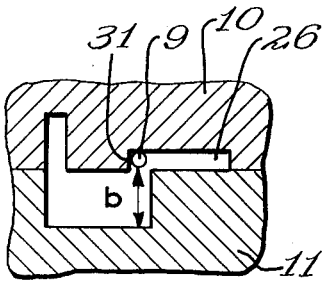
Figure 2C:
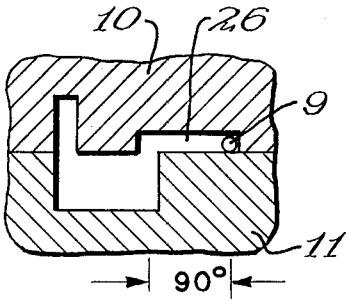

FIG. 2 shows positions for locking the pin 9 attached to the spindle 7. The diagram (a) shows the completely close position of the cock 2, i.e. the position of the pin 9 in the initial state. In the diagram (a), the pin 9 is allowed to move downward by a depth a. This movement is effected by pushing the knob 23; the pin 9 is downward moved by the depth a when the safety valve 16 acquires the open position. The second operation consists of turning the knob 23 by 90°. At this moment, the gas is supplied to the pilot flame. The third operation consists of releasing the knob 23 from being pressed when the safety valve 16 is maintained at the open position after the pilot flame has been established. At this moment, the pin 9 is returned upwards by a depth b to acquire a position shown in the diagram (b). In the fourth operation, the knob 23 is further turned by 90°, whereby the gas is supplied to the main burner flame, and the pin 9 is fitted to the groove 26 as shown in the diagram (c).

Figure 3:
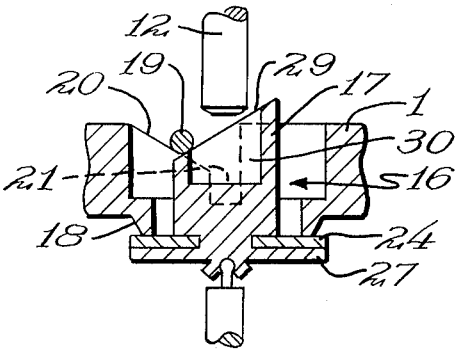
FIG. 3, FIG. 4 and FIG. 5 are cross-sectional views showing the relations between the second pin and the reset shaft.
Figure 4:
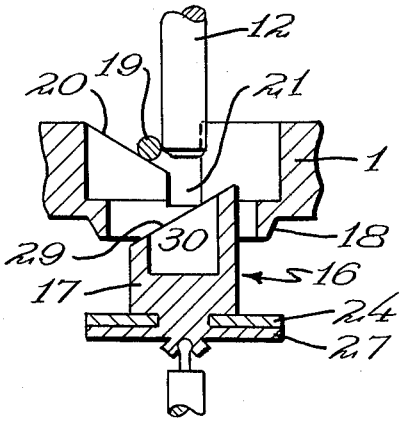
Figure 5:
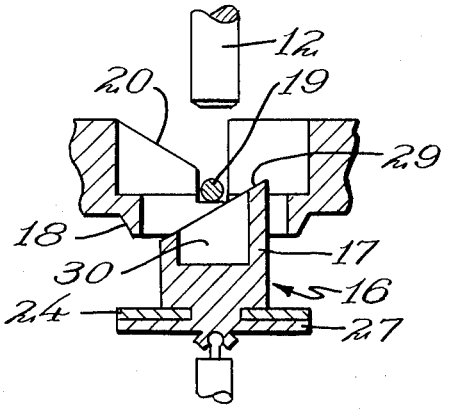
Figure 6:
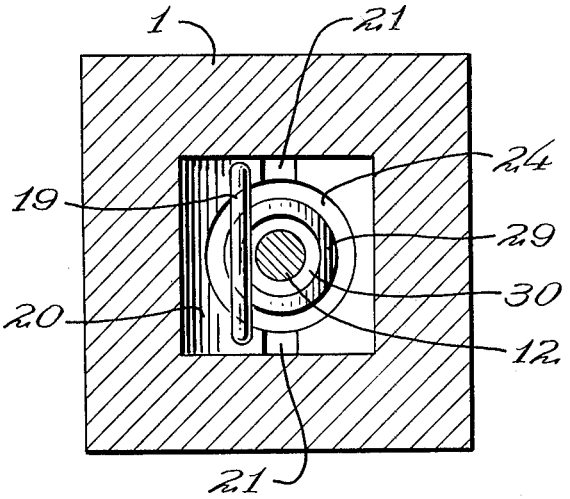
FIG. 6 is a cross-sectional view when the device is looked down from the line X—X′ of FIG. 1.
Figure 7:
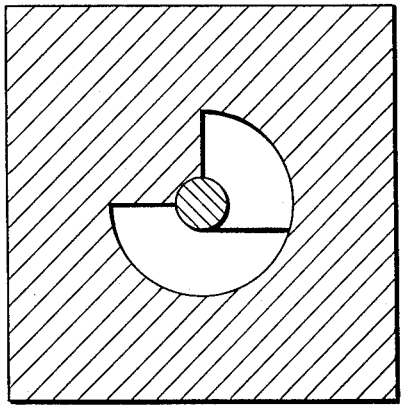
FIG. 7 is a cross-sectional view when the device is looked down from the line Y—Y′ of FIG. 1.

Referring to FIG. 1, a second pin 19 is movably supported on an inclined surface 20 formed on the lower portion 1 of the casing and the upper surface 29 of valve 16. The pin 19 consists of a round rod and is allowed to move along the inclined surface 20 as shown in FIG. 3, FIG. 4 and FIG. 5. FIG. 3 shows a position of the pin 19 in the initial state. The pin 19 is held in place between the inclined surface 20 and the upper surface 29 of safety valve head 17. If the knob 23 is pushed in the first operation so that the reset shaft 12 pushes the safety valve head 17, the safety valve head 17 is driven downward and, instead, the reset shaft 12 comes into contact with the pin 19. The pin 19 at this moment is interposed between the reset shaft 12 and the inclined surface 22 and remains in the initial position. In the third operation, the knob 23 is released from the pressed state and the reset shaft 12 is allowed to return to the upper direction. At this moment, the lower end of the reset shaft 12 comes into contact with the pin 19 as shown in FIG. 4, and the pin 19 is located at a position sandwiched between the inclined surface 20 and the reset shaft 12. While the combustion is taking place with the safety valve 16 being opened, the pin 19 remains located at a position shown in FIG. 4. When the flame is extinguished by turning knob 23 to the initial position so pin 9 is as shown in FIG. 2(*a*), only the reset shaft 12 returns to the initial position. When the restoration operation of the safety valve 16 to the close position is delayed, the pin 19 falls from the inclined surface 20 onto the groove 21 as shown in FIG. 5. At this moment, even if the knob 23 is pushed, the movement of the reset shaft 12 toward the axial direction is interrupted by the pin 19; the reset shaft is not allowed to turn as pin 9 remains in groove or detent 33.

Figure 8:
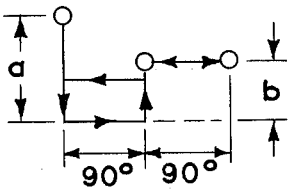
FIG. 8 is a drawing for illustrating the operating conditions of the operation member.

To stop the combustion of the pilot flame and the main burner flame, the operation should be carried out in the following manner. That is, operate the knob 23 to turn the cock 2. At this moment, the pin 9 moves from the position of diagram (c) of FIG. 2 to the position of diagram (b) and comes into contact with the wall 31. The gas is interrupted from being supplied to the main burner flame but is supplied to the pilot flame only. The knob 23 is then turned while being pushed, and the pressing force is released from the knob 23 when it has come into contact with the wall 32 as shown in the diagram (a) of FIG. 2. The pilot flame is extinguished to acquire the initial state. To start the combustion, the knob should be operated from the close position to the open position via the pilot flame position as indicated by arrows in FIG. 8. To stop the combustion, the knob should be operated in reverse order as indicated by arrows of opposite direction as shown in FIG. 8. At the close position, the gas is supplied neither to the pilot flame nor to the main burner flame. At the pilot flame position, the gas is supplied to the pilot flame only, and at the open position, the gas is supplied to both the pilot flame and the main burner flame.

The supply of gas must be quickly interrupted in case the flame is extinguished in either the pilot flame position or the open position. In this case, although the electromotive force of the thermocouple may diminish, the residual heat retards the closure of the safety valve 16 after the flame has been extinguished. When the resilient force of the return spring 15 has overcome the diminishing electromotive force of the thermocouple, the safety valve 16 is closed, and the valve disk 24 comes into pressed contact with the valve seat 18.

If the flame is extinguished and the operation is effected again before the safety valve 16 is completely closed, the turn of the cock from the close position toward the pilot flame position or the open position permits the live gas to flow out. Such a repetitive operation could be prevented relying upon the discrimination of a person who operates or by observing the flame port. Such methods, however, lack reliability and, in addition, it often will be difficult to reliably observe the flame port.

According to the present invention, the safety device is so constructed that if the safety valve is once operated, the next operation is never allowed to be carried out unless the safety valve is completely restored to the close position, thereby to enchance the safety performance. The features and functions of the device according to the present invention are mentioned below.

DESCRIPTION OF THE OPERATION OF THE INVENTION

Prior to starting the operation, the device of the invention acquires the position shown in FIG. 1. The first operation consists of pushing the knob 23 to depress the safety valve head 17 via the spindle 7 and the reset shaft 12, so that the valve disk 24 acquires the open position. The second operation consists of turning the knob 23 by 90° while it is being pushed, so that the cock 2 comes to the position of pilot port to supply the gas to the pilot port. The pilot port is then ignited, and when the electromagnetic device 14 is energized by the electromotive force of the thermocouple, the knob 23 is released from the pushed state. At this moment, the knob 23 is allowed to return upwards by a distance b. In FIG. 2, the position of the knob 23 is indicated by the position of the first pin 9 attached to the spindle 7. As the knob 23 is further turned by 90°, the cock 2 acquires the open position whereby the pilot flame and the main burner flame are allowed to burn. In the aforesaid operation, the second pin 19 remains in the initial position. If now the flame is extinguished, the electromagnetic device 14 is de-energized being delayed by some periods of time. The safety valve 16 remains open during this delay time, and at this time, the knob 23 is returned to the initial position, i.e. returned to the close position shown in the diagram (a) of FIG. 2. At this moment, as shown in FIG. 5, the second pin 19 of which right side is not supported by the reset shaft 12 is allowed to fall from the inclined surface 20 onto the groove 21. Therefore, even if the knob 23 is pushed, the downward motion of the reset shaft 12 is restricted by the pin 19, whereby the knob 23 is not allowed to be turned. Then, after the delay time has passed, the safety valve 16 returns to the close position whereby an inclined edge portion 29 (inclined in a direction opposite to the incline surface 20) of the safety valve head 17 so works that the second pin 19 is pushed up again onto the inclined surface 20; the second pin 19 returns to the initial position. This allows the operation to be effected again. That is, unless the safety valve 16 is restored to the close position, the reset shaft 12 comes into contact with the second pin 19 and is allowed to move no more in the axial direction. If illustrated with reference to the diagram (a) of FIG. 2, the first pin 9 cannot escape from the groove 33 whereby the spindle 7 and the knob 23 are prevented from being turned.

As mentioned above, according to the device of the present invention for use in gas burners that will be operated in the order of from the close position to the open position, the second or subsequent operation from the close position is now allowed to be effected unless the safety valve is restored to the inoperative position (close position). The setup of the present invention comprises the operation member (knob 23, spindle 7, reset shaft 12) which moves in the axial direction and rotates with the axis as a center, a holder device (electromagnetic device 14) for holding the safety valve 16 in the operative position when it is moved to the operative position by the operation member, means (thermocouple device not diagrammatized) for energizing the holder device after having confirmed the presence of burning flame, and the cock 2 provided on the gas flow-out side of the safety valve 16 to turn in the same direction as the operation member when said operation member is turned, wherein in order to inhibit the operation from the close position toward the open position unless the safety valve 16 is restored to the inoperative position after the combustion flame has been extinguished, the movement of the operation member in the axial direction is prevented by pin 19 so that said operation member is not rotated but prevented by pin 9, so that the gas is prevented from flowing to the pilot flame or to the main burner flame.

The embodiments of the invention in which an exclusive property or right is claimed are defined as follows:

1. A safety device adapted for use with a gas combustion apparatus having a pilot which is proven by a thermocouple, comprising, a valve body having an inlet opening adapted to be connected to a source of gas under pressure, outlet opening adapted to be connected to a main burner of the combustion apparatus, and a second outlet opening adapted to be connected to a pilot, safety valve means connected between said inlet opening and said outlet openings to shut off gas flow when in an inoperative position and held in an operative position by an electromagnetic device energized by a pilot heated thermocouple, main valve means connected in series with said safety valve means, manual means movable in an axial and rotative direction connected to said main valve means axially from said inoperative position to said operative position and for rotating said main valve means from an off to on position, first means connected to said manual means for preventing said manual means from rotating said main valve means to said on position unless said manual means is in said operative position, and first pin means dropping in a groove in line with said safety valve means in said body when said safety valve means is in said operative position for preventing axial movement of said manual means to said operative position and thus said manual means is not in a position for rotative movement of said main valve means from said off position to said on position.

2. The invention of claim 1 wherein said manual means connecting said manual means to said safety valve means comprises a member attached to said safety valve means having an inclined surface cooperating with an inclined surface of said valve body, and said first pin means normally held in a restricted position from interfering with said manual means and from said groove by the inclined surfaces of said safety valve and said body; however, upon operation of said safety valve means to the operative position, said pin means drops into said groove to restrict the axial movement of said manual means to a position in which said manual means can be rotated to open said main valve means.

3. The invention of claim 2 wherein said first means comprises second pin member attached to said manual means and detent means in said valve body cooperating with said second pin member for restricting the rotational movement of said manual means depending upon the axial position of said manual means and to allow for movement of said manual means in a rotating manner for a predetermined angle of movement of said manual means when said manual means is in a first axial position.

4. The invention of claim 3 wherein said inclined surfaces form a support for said first pin in said restricted position and upon said safety valve moving to said operative position, said pin slides down said inclined surface of said body into said groove.

5. A safety gas valve adapted for use with a gas combustion apparatus having a pilot burner and a main burner wherein a safety valve provides for the flow of gas from an inlet opening adapted to be connected to a source of gas under pressure through a main valve member to a pilot outlet opening and a main burner outlet opening adapted to be connected to a pilot burner and a main gas burner whenever a flame proving apparatus associated with the pilot burner determines that a pilot flame exists and when a manual operator turns the main valve to an off position, the manual operator cannot be moved to an on position as long as the safety valve is open as a result of the residual heat of the flame proving device, the improvement comprising, means connecting the manual operator to said safety valve having a pin member which is held in an inactive position when the safety valve is closed and moves to a restricting position in a groove in the valve body when the safety valve is opened to prevent a manual operating means from moving axially to a position for rotative movement for opening the main valve until the safety valve is in an inoperative position.

* * * * *